United States Patent [19]

Churla

[11] 4,055,980

[45] Nov. 1, 1977

[54] DIE SET

[75] Inventor: John J. Churla, Belle Mead, N.J.

[73] Assignee: Thomas & Betts Corporation, Elizabeth, N.J.

[21] Appl. No.: 733,188

[22] Filed: Oct. 18, 1976

[51] Int. Cl.[2] ..... B21J 9/08

[52] U.S. Cl. ..... 72/410; 72/416

[58] Field of Search ..... 72/410, 409, 412, 416, 72/470; 29/751

[56] References Cited

U.S. PATENT DOCUMENTS

| | | | |
|---|---|---|---|
| 3,314,135 | 4/1967 | Smith | 29/751 |
| 3,359,779 | 12/1967 | Filia | 72/416 |
| 3,504,417 | 4/1970 | Filia | 29/751 |
| 3,523,351 | 8/1970 | Filia | 29/751 |
| 3,576,122 | 4/1971 | Churla | 72/413 |

*Primary Examiner*—C.W. Lanham
*Assistant Examiner*—Gene P. Crosby
*Attorney, Agent, or Firm*—David Teschner; Jesse Woldman

[57] ABSTRACT

The invention is directed to a die set wherein both the upper and lower die members are molded of a semi-rigid, flexible material. The physical properties of the materials from which the die members are formed are such that they resemble those of typical conductor and connector insulations. The dies can deform around the insulation of the conductor and shield without nicking, cutting or otherwise damaging the metallic conductor or other portions of the insulated conductor. The dies can conform to concentric and nonconcentric conductor configurations and are thus not sensitive to the conductor concentricity and to the conductor size in the range of conductor sizes the dies are formed to handle. The use of alignment ribs, along with the die interlocks serve to center the two die members and stops serve to prevent rotation of a connector in the die set and control the maximum die set opening.

22 Claims, 22 Drawing Figures

DIE SET

CROSS-REFERENCE TO RELATED APPLICATION

CONNECTOR, Ser. No. 732,331; filed Oct. 14, 1976 in the name of JOHN J. CHURLA, JR. and assigned to the assignee of the instant invention by this reference made a part hereof.

BACKGROUND OF THE INVENTION

1. Field of the Invention:

The invention is directed to the deformation of deformable fasteners to articles placed in such fasteners and mor particularly to the crimping of a ground conductor to the shield of a shielded, jacketed cable from which a part of the jacket has been removed.

2. Description of the Prior Art:

Die sets fabricated according to prior art teachings required the machining of hard tool steels for the various components of the die sets. Accurate polishing and assembly of the components was time consuming and resulted in a matched upper and lower die member which was not readily interchangable with dike die components.

One attempt to eliminate some of these problems is shown in U.S. Pat. No. 3,576,122 issued Apr. 27, 1971 entitled "Crimping Tool" by John J. Churla, Jr. and assigned to the assignee of the instant invention. The die set of this patent shows a number of die members which consist of nest blocks fabricated from semirigid, flexible material, but which require, in addition, support blocks and end blocks. The control of these nest blocks during crimping is achieved by the interengagement of the semirigid, flexible material of the nest blocks with the metal portions of the other die member of the die set. The die set of such patent requires the accurate machining, polishing and assembly of many components to produce the desired structure.

SUMMARY OF THE INVENTION

The present invention overcomes the shortcomings of prior art die sets by providing a die set in which both die members are molded of semirigid, flexible materials and which provide all support and stops and omit the requirement for accurately machined or matched parts which must be assembled. The upper die member is molded of a high yield strength plastic material of limited flexibility and provided with a die nest, position controlling ridges, and anti-rotational ribs. The lower die member is molded of a more flexible plastic material and provided with a die nest, position controlling ridges, anti-rotational ribs, connector stops and die set opening stops. The centering of the upper and lower die members is controlled by the interengagement of the position controlling ridges on the upper and lower die members. The contour of the joint is controlled by the composite shapes of the die nests of the upper and lower die members since the dies can deform around the insulation of a conductor or connector without regard for the concentricity of the conductor or connector and over a range of conductor sizes within the die set range. The lower die member also provides a stop to prevent a connector from rotation as it is crimped. A further stop on the lower die member limits the maximum separation of the upper and lower die members, and a resilient member is coupled between the die members to assure their separation after a crimp has been made. Strengthening braces and anti-rotational ribs prevent rotation of the die members during opening or closing of the die set. It is an object of this invention to provide an improved die set.

It is another object of this invention to provide a novel die set, the members of which are fabricated by molding. It is a further object of this invention to provide a novel die set, the members of which are fabricated from plastics of different physical properties.

It is still a further object of this invention to provide a novel die set, the members of which are molded from plastics of different physical properties.

It is still another object of this invention to provide a novel die set wherein the die members can deform about a conductor, connector or joint without regard for the concentricity of the conductor, connector or joint.

It is yet another object of this invention to provide a novel die set in which the die members are provided with antirotational ribs to prevent rotation of the die members with respect to the device used to drive the members of the die set.

It is still another object of this invention to provide a novel die set in which the die members have stops to limit maximum opening of the die members and to prevent rotation of a connector crimped in said die set.

Other objects and features of the invention will be pointed out in the following descriptions and claims and illustrated in the accompanying drawings, which disclose, by way of example, the principles of the invention, and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
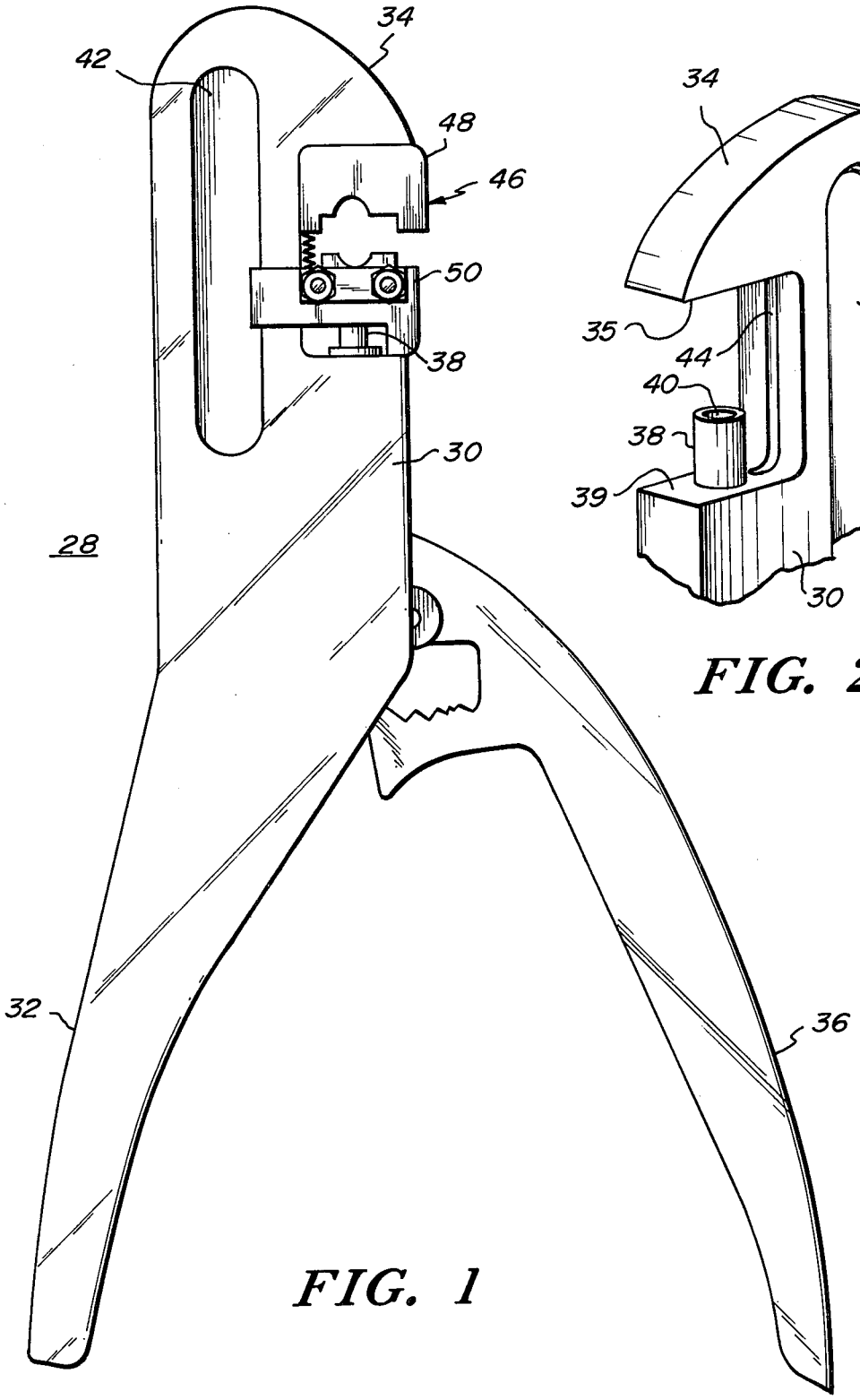
FIG. 1 is a front elevational view of a crimping tool having installed thereon a die set constructed in accordance with the concepts of the invention.
Figure 2:
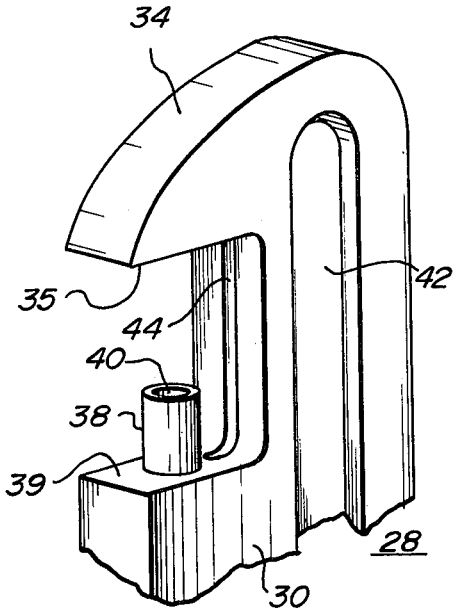
FIG. 2 is a fragmentary perspective view of the tool frame of FIG. 1 showing additional details thereof.
Figure 3:
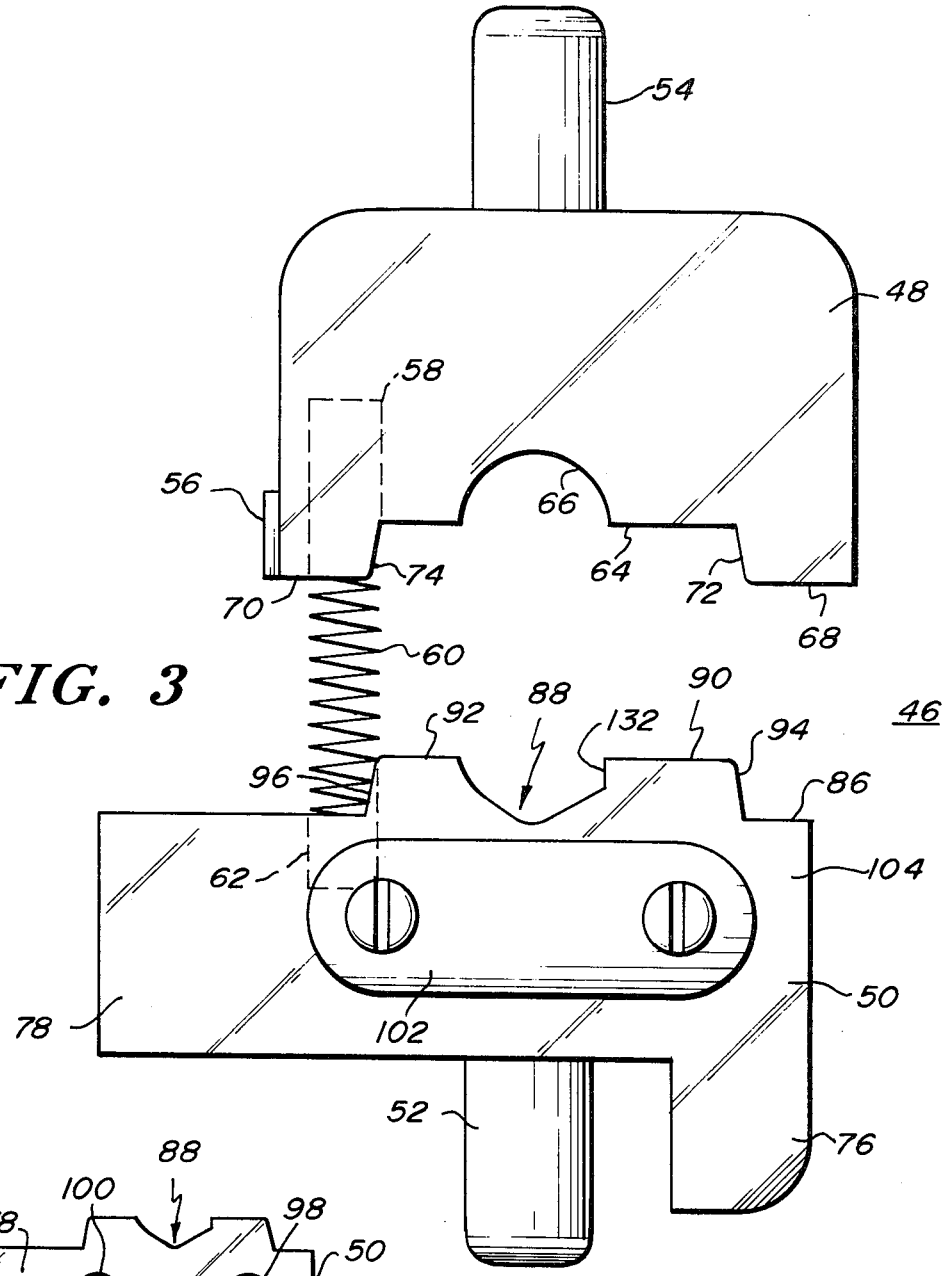
FIG. 3 is a front elevational view of a die set constructed in accordance with the concepts of the invention.

Turning now to FIGS. 1, 2 and 3 the details of the die set 46 constructed according to the concepts of the invention are shown. The tool 28 is shown in greater detail in U.S. Design Pat. DES No. 192,940, issued May 29, 1962 and now expired, entitled Crimping Tool in the names of Martin and Schwester and assigned to the assignee of the instant invention. Tool 28 has a frame 30 ending in a first fixed handle 32 and a first fixed jaw 34. Movable handle 36 is arranged to move a ram 38 towards fixed jaw 34 as movable handle 36 is moved towards fixed handle 32 and moves ram 38 away from fixed jaw 34 as movable handle 36 is moved away from fixed handle 32. The movement of the ram 38 is controlled by mechanisms well known in the art. Ram 38 has an aperture 40 to receive the stem 52 of lower die member 50 to position such lower die member 50 as ram 38 is moved. A similar aperture, not visible in the drawings, is placed in the face 35 of the fixed jaw 34 to receive stem 54 of the upper die member 48. Two external recesses 42 (only one of which is visible in each of the FIGS. 1 and 2) appear in the frame 30 in the region between fixed jaw 34 and ram 38. An internal slot 44 (see FIG. 2) extends in the same general region. As will be set forth in greater detail below, the recesses 42 and the slot 44 will be employed with various die member ribs to prevent rotation of the die set 46 in a plane parallel with face 35 of the fixed jaw 34.

Figure 5:
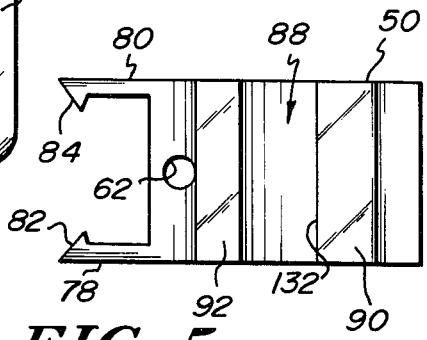
FIG. 5 is a top plan view of the lower die member of FIG. 4.

Die set 46 is composed of an upper die member 48 and a lower die member 50, both fabricated by molding. In a preferred form of the die set 46, upper die member 48 is molded from glass filled elastomer having a yield strength of approximately 5,000 to 8,500 psi and a 300,000 psi flexural modulus while the lower die member is molded from urethane having a yield strength of approximately 2,000 psi to 5,000 psi and a 100,000 psi flexural modulus. The die members can be reversed with suitable structural reversals and other and different moldable materials can be employed without departing from the spirit of the invention. Upper die member 48 has a stem 54 which is tightly received in an aperture (not shown) in face 35 of fixed jaw 34. The aperture is so positioned and the stem 54 so molded that as forces are exerted normal to face 35 the upper die member 48 tends to move back against the tool frame 30 flanking slot 44, thus assuring proper positioning of the die set 46. An antirotational rib 56 is molded on a rear face of upper die member 48 to enter slot 44 and thus prevent rotation of upper die member 48 in a plane parallel with face 35 of fixed jaw 34. The position of upper die member 48 with respect to lower die member 50 when the ram 38 is in its most retracted position, as shown in FIG. 1, is established by compression spring 60 which terminates in a recess 58 in upper die member 48 and a recess 62 in lower die member 50 (see FIG. 5). The planar bottom surface 64 of upper die member 48 is interrupted by a semicircular die nest 66 and two positioning ridges 68,70 flanking die nest 66. The interior surfaces of the ridges 68,70 are inclined as at 72,74 respectively, and in conjunction with similar surfaces on lower die member 50 center the die nests of upper die members 48 and lower die member 50. The die nest 66 is shown as semicicular. However, any convenient shape that may be desired or required may be employed.

Figure 4:
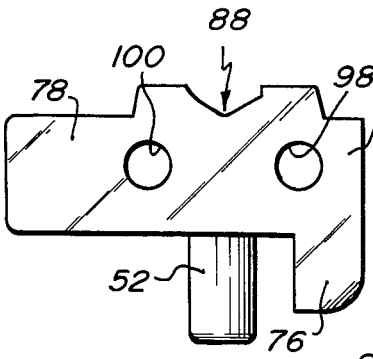
FIG. 4 is a front elevational view of the lower die member of the die set of FIG. 3 with a brace removed to disclose additional details.

The lower die member 50 has a stem 52, which, as set forth above, fits into aperture 40 of ram 38. A stop 76 is formed on lower die member 50 adjacent stem 52. The stop 76 contacts the planar face 39 adjacent ram 38 and limits the downward travel of lower die member 50. In this way the spacing between the die members can be controlled so that sufficient spacing is available to insert the connector and the conductors easily but at the same time limit the necessary upward travel of the lower die member 50 to complete the crimping operation. Lower die member 50 has two ribs 78,80 (See FIG. 5) which extend from the die area to the recesses 42. Each of the ribs 78,80 terminates in a tapered, inwardly directed surface 82,84 respectively, to facilitate the assembly of lower die member 50 to the tool frame 30. The ribs 78,80 serve to prevent the rotation of lower die member 50 in a plane parallel with the planar face 39 of frame 30. The planar face 86 of lower die member 50 is interrupted by die nest 88 and positioning ridges 90,92 flanking such nest 88. The exterior surfaces of the ridges 90,92 are inclined as at 94,96. When lower die member 50 is moved to engage upper die member 48, exterior surfaces 94,96 engage interior surfaces 72,74 respectively to align nests 66 and 88. The tops of ridges 90,92 of lower die member 50, are made to engage planar surface 64 of upper die member 48 to either side of nest 66 and the tops of ridges 68,70 of upper die member 48 engage planar surface 86 of lower die member 50 to prevent flash, that is, material of the connector placed in die set 46 from being forced out of the die nests along the parting line of the upper and lower die members 48,50 respectively. To control the deflection, or distortion, of lower die member 50 two apertures 98, 100 (see FIG. 4) are placed therein and braces 102 (only one is visible in FIG. 3) are placed on either side surface 104 (only one is visible in FIG. 3) and fastened by fasteners 106,108 extending through apertures in braces 102 and apertures 98,100 of the lower die member 50.

Figure 7:
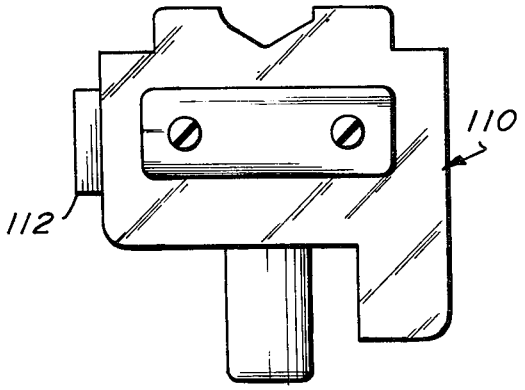
FIG. 7 is a front elevational view of a further embodiment of a lower die member constructed in accordance with the concepts of the invention.
Figure 8:
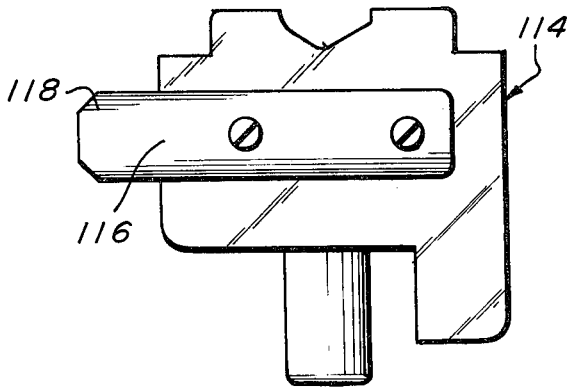
FIG. 8 is a front elevational view of a further embodiment of a lower die member constructed in accordance with the concepts of the invention.
Figure 9:
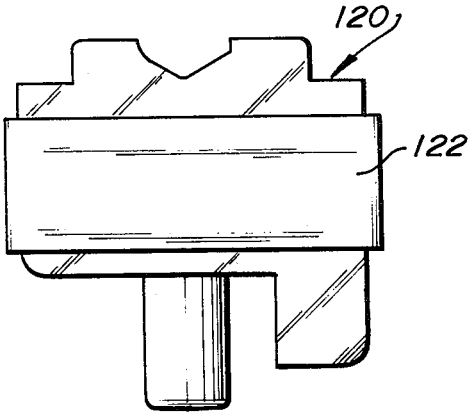
FIG. 9 is a front elevational view of yet a further embodiment of a lower die member constructed in accordance with the concepts of the invention.
Figure 10:
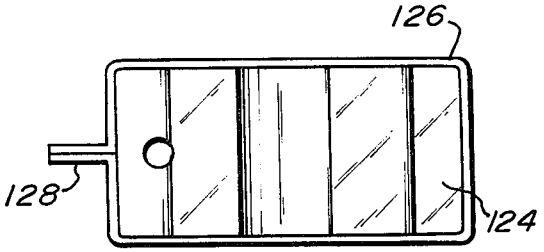
FIG. 10 is a top plan view of still a further embodiment of a lower die member constructed in accordance with the concepts of the invention.

If desired, the anti-rotational rib of the lower die member 110 may be molded in a manner similar to rib 56 of upper die member 48. Such a molded anti-rotational rib is shown at 112 in FIG. 7. Also, the anti-rotational rib and braces may be combined as a single unit, as shown in FIG. 8. Lower die member 114 has two plates 116 (only one of which is visible in FIG. 8) which serve as the braces 102 of FIG. 3 and the extending portions 116 which extend to the recesses 42 and have inturned ends (not shown) to provide the anti-rotational control of the lower die member 114. FIG. 9 shows the use of a more rigid box-like member 122 about lower die member 120, and, if desired, a rib 128 can be formed from the ends of the box-like member 126 surrounding lower die member 124, as is shown in FIG. 10.

Figure 6:
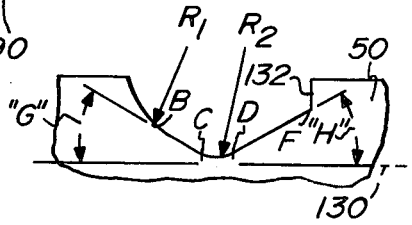
FIG. 6 is an enlarged, fragmentary front elevational view of the die nest of the lower die member of FIG. 4.

Turning now to FIGS. 3 and 6, the details of die nest 88 can better be understood. The die nest 88, starting from the left side of FIG. 6, has a first segment of a circle with a radius of curvature $R_1$ from point A to point B, and a linear portion from point B to point C at an angle G to a plane 130 coextensive with planar portion 86 of the lower die member 50. Further, a second segment of a circle from point C to point D with a radius of curvature $R_2$ finally terminates in a linear portion from point D to point F at an angle H to the plane 130. In a typical arrangement, the radius of curvature $R_2$ will be longer than $R_1$ and the angle G will be approximately 40 degrees, while angle H will be approximately 30 degrees. At the end of the linear segment from point D to point F there is a portion 132 which, as will be described below, acts as a stop to prevent the rotation of a connector in the die set 46 during crimping.

Figure 11:
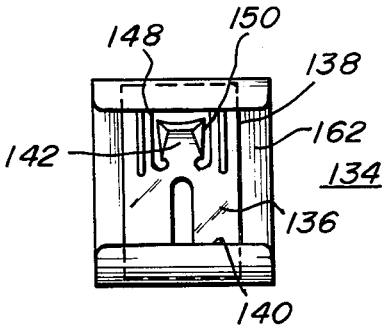
FIG. 11 is a side elevation of a connector to be applied to conductors by the tool of FIG. 1.
Figure 14:
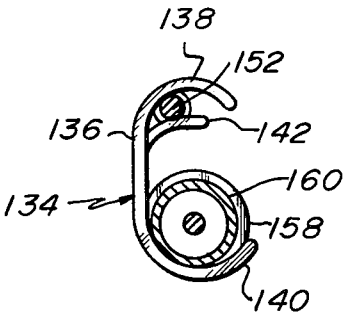
FIG. 14 is a front elevational view of the connector and conductors of FIG. 13 in an initial position.
Figure 15:
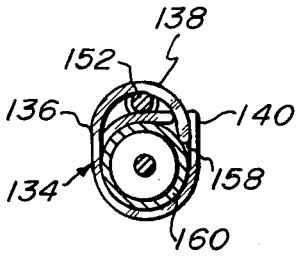
FIG. 15 shows the final positions assumed by the connector and conductors of FIG. 14.

The connector 134 is fully described and illustrated in the above identified copending application and is described herein in summary fashion only to appreciate the operation of the instant invention. The connector 134 (See FIG. 11) is generally C-shaped with a central portion 136 terminating at a first end 138 having a first radius of curvature and a second end 140 having a second radius of curvature greater than said first end 138. As a result, as the connector is crimped first end 138 tends to move inside second end 140 and second end 140 moves over first end 138. Struck from the central portion 136 is a tab 142 which takes on a curved shape having a radius of curvature longer than the radius of curvature of end 140. The tab 142 divides the interior of the connector 134 into two cavities. Cavity 144 extends between second end 140 and tab 142 and receives the shield 160 of shielded, jacketed cable 156 from which a portion of the jacket 158 has been removed (see FIG. 13). Cavity 146 extends between first end 138 and tab 142 and receives the bared metal 152 of conductor 154. As shown in FIG. 14, before connector 134 is crimped, the bared metal 152 rests close to the central portion 136 but as the connector 134 closes about shield 160 to the bared metal portion 152 moves close to the free end of first end 138, thus permitting the tab 142 to also bend and prevent the tab 142 from damaging the cable 156. FIG. 15 shows the connector 134 fully crimped about shield 160 of cable 156 with ground conductor 154 also retained by connector 134.

Figure 16:
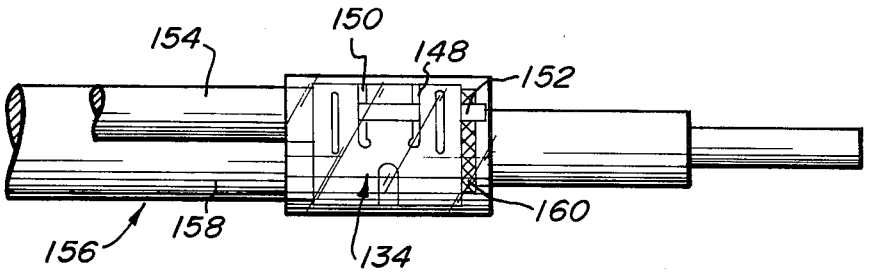
FIG. 16 is a fragmentary side elevation of the assembled connector and conductors.

Returning again to FIG. 11, the tab 142 is separated from central portion 136 along its longer edges by slots 148, 150, respectively. An insulating film 162 covers the outer surface connector 134 and is joined to itself at the extreme edges beyond the metal of the central portion 136 so that the joint between the connector 134 and cable 156 is insulated without the requirement for additional insulation. As shown in FIG. 16, the connector 134 completely encircles the shield 160 of cable 156 from which jacket 158 has been removed. The bared metal portion 152 of conductor 154 runs along the cable 156 under connector 134, through slot 150 over the back surface of tab 142 through slot 148 and under connector 134. By passing a portion of the ground conductor 154 behind the tab 142 the overall joint is smaller and the tendency to free tab 142 into the cable 156 is removed.

Figure 12:
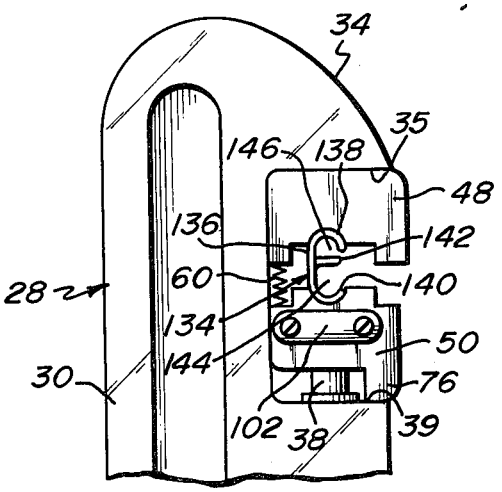
FIG. 12 is a fragmentary, front elevational view of the tool of FIG. 1 with a connector as shown in FIG. 11 positioned in the die set.
Figure 13:
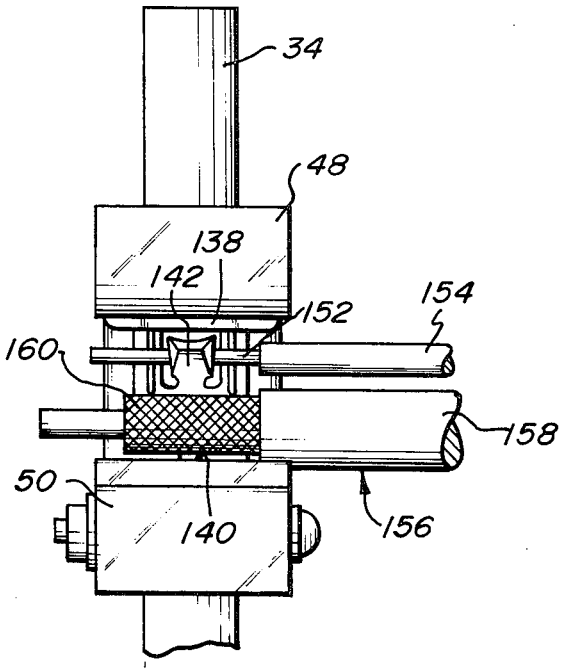
FIG. 13 is a fragmentary side elevational view of the tool and connector of FIG. 12 with the shield of a shielded, jacketed cable and the bared portion of a ground conductor both positioned within the connector.

Turning now to FIGS. 12 and 13, the tool 28 is shown in its open position with ram 38 fully retracted and a connector 134 in the die set 46. The downward movement of the lower die member 50 is determined by the stop 76 which engages face 39 of the tool 28. The fit of the stem 52 into aperture 40 in ram 38 is loose and the stem 52 is sufficiently long to permit movement of the ram 38 to its fully retracted position without the lower die member 50 falling from the tool 28. As stated above, stop 76 limits the opening of the die set 46 so that just enough room to place a connector 134 in the die set 46 exists. In this way the user does not have to worry about holding the connector 134 in the die set 46 while he places the shield 160 of the cable 156 and conductor 154 in place, as shown in FIG. 13.

Figure 17:
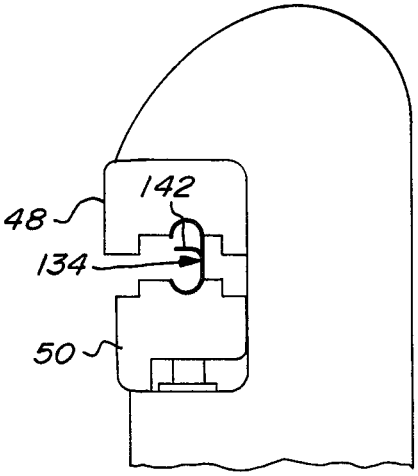
FIGS. 17 to 22 show the successive steps through which the die set and connector move to complete a crimping operation. The conductors have been omitted to permit the details of the die set and connector to be more easily appreciated.
Figure 18:
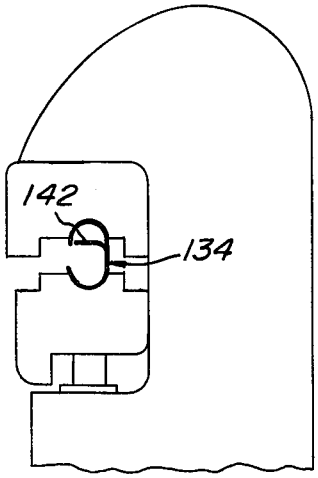
Figure 19:
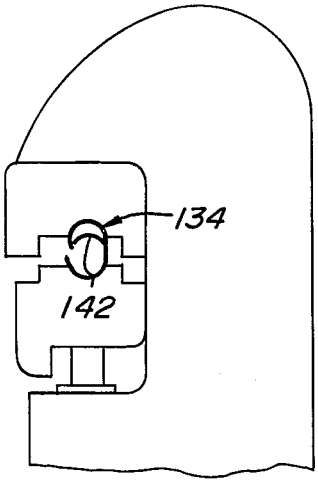

With the cable 156 and conductor 154 in place, movable handle 36 is moved towards fixed handle 32 and lower die member 50 moves towards die member 48. As shown in FIGS. 17 to 22, the wraparound of the connector 134 is shown. The conductor 154 and cable 156 have been omitted to make it easier to see the connector 134 close. FIG. 17 shows the fully retracted position of lower die member 50 and the initial appearance of connector 134. As the lower die member 50 moves towards fixed, upper die member, cavity 146, which would receive the bared metal 152 of ground conductor 154 closes. Stop 132 is engaged by the free end of second end 140 of connector 134 which prevents the connector 134 from rotating rather than closing as lower die member 50 is moved. FIG. 19 shows the cavity 146 virtually closed near the central portion 136 of connector 134 and open near the end 138 and the free end of tab 142. The free end of end 140 is beginning to move outside of end 138 which is moving to the inside of end 140.

Figure 20:
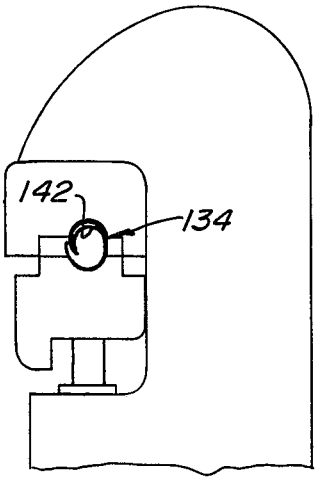
Figure 21:
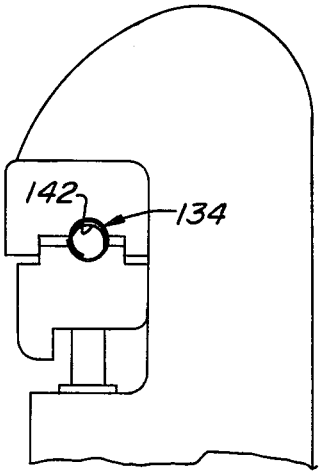
Figure 22:
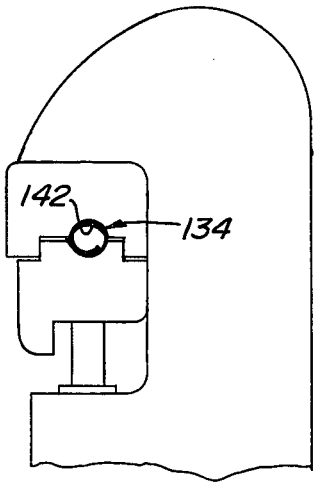

In FIG. 20, the connector 134 is closed and end 138 has moved inside of end 140 which has moved outside of end 138. The cavity 146 is shown completely closed because no conductor is present but would not do this with a conductor therein.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A die set comprising: a first die member fabricated of a semi-rigid, flexible material and having first and second spaced apart, generally parallel faces; a first recess in said first face to receive a portion of the periphery of a deformable fastener; first and second ridges on said first face, one to either side of said first recess and spaced apart by a first predetermined distance; and a second die member fabricated of a semi-rigid, flexible material and having third and fourth spaced apart, generally parallel faces; a second recess in said third face to receive a portion of the periphery of a deformable fastenera; third and fourth ridges on said third face, one to either side of said second recess and spaced apart by a second predetermined distance less than said first predetermined distance; the engagement of said third and fourth ridges with said first and second ridges when said first and second die members are brought together, align said second recess with said first recess to substantially, completely envelope a deformable fastener placed in said die set first and second recesses when said first face of said first die member is in contact with said third face of said second die member.

2. A die set as defined in claim 1, wherein said first recess in said first die member is substantially semicircular.

3. A die set as defined in claim 1, wherein said second recess in said second die member is made up of segments of circles and linear portions.

4. A die set as defined in claim 1, wherein said first recess in said first die member is substantially semicircular and said second recess in said second die member is made up of segments of circles and linear portions.

5. A die set as defined in claim 1, wherein said first recess in said first die member is substantially semicircular and said second recess in said second die member is made up of alternating segments of circles and linear portions.

6. A die set as defined in claim 1, wherein said second recess in said second die member terminates in a further recess at one end thereof, said further recess engaged by a deformable fastener placed in said die set to prevent rotation of such fastener as said first and second die members are brought into contact with one another.

7. A die set as defined in claim 1, wherein said first die member is fabricated of a plastic material having a yield strength of approximately 5,000 psi to 8,500 psi.

8. A die set as defined in claim 1, wherein said second die member is fabricated of a plastic material having a yield strength of approximately 2,000 psi to 5,000 psi.

9. A die set as defined in claim 1, wherein said first die member is fabricated of a plastic material having a yield strength of approximately 5,000 psi to 8,500 psi and said second die member is fabricated of a plastic material having a yield strength of approximately 2,000 to 5,000 psi.

10. A die set as defined in claim 1, wherein said first die member is fabricated of a glass filled elastomer having a yield strength of approximately 5,000 psi to 8,500 psi and said second die member is fabricated of urethane having a yield strength of approximately 2,000 psi to 5,000 psi.

11. A die set as defined in claim 1, wherein said second die member has strengthening braces on two, parallel exterior sides intermediate said third and fourth faces.

12. A die set as defined in claim 1, wherein said second die member has a stop member extending from said fourth face of said second die member to limit the spacing between said first face of said first die member and said third face of said second die member as said first die member and said second die member are moved away from each other.

13. A die set as defined in claim 1, further comprising resilient means coupled to said first die means and said second die means to bias said first and second die means away from one another.

14. A die set as defined in claim 1, further comprising a compression spring coupled to said first die means and said second die means to bias said first and second die means away from one another.

15. A die set as defined in claim 1, wherein said first die member and said second die member are fabricated by molding.

16. A die set defined in claim 1, wherein said first die member further comprises an alignment rib to prevent rotation of said first die member in a plane paralled with said first face of said first die member.

17. A die set as defined in claim 1, wherein said second die member further comprises an alignment rib to prevent rotation of said second die member in a plane parallel with said third face of said second die member.

18. A die set as defined in claim 1, wherein said first die member further comprises a first alignment rib and said second die member further comprises a second alignment rib, said first and said second alignment ribs preventing the rotation of said first die member and said second die member, respectively, in a plane parallel with said first face of said first die member.

19. A die set as defined in claim 1, wherein said second die member further comprises strengthening braces on two, parallel exterior sides intermediate said third and fourth faces; and an alignment rib to prevent the rotation of said second die member in a plane parallel with said third face of said second die member.

20. A die set as defined in claim 1, wherein said second die member further comprises strengthening braces on two, parallel exterior sides intermediate said third and fourth faces; and an alignment rib to prevent the rotation of said second die member in a plane parallel with said third face of said second die member; said braces and said alignment rib being fabricated as an integral unit.

21. A die set defined in claim 1, wherein said second die member further comprises a strengthening member completely encasing said second die member except for said third and fourth faces thereof.

22. A die set as defined in claim 1, wherein said second die member further comprises a strengthening member completely encasing said second die member except for said third and fourth faces thereof and an alignment rib on said strengthening member to prevent the rotation of said second die member in a plane parallel with said third face of said second die member.

* * * * *